United States Patent [19]

Lagasse et al.

[11] 4,205,546

[45] Jun. 3, 1980

[54] PROCESS FOR FORMING CURVED HOLLOW ELEMENTS AND AN APPARATUS FOR CARRYING OUT THIS PROCESS

[75] Inventors: Paul-Emile H. Lagasse, Wavre; Ferenc J. Virag, Ottignies Louvain-la-Neuve, both of Belgium

[73] Assignee: Spiro Investment S.A., Boesingen, Switzerland

[21] Appl. No.: 914,226

[22] Filed: Jun. 9, 1978

[30] Foreign Application Priority Data

Jun. 9, 1977 [LU] Luxembourg ..... 77511

[51] Int. Cl.[2] ..... B21D 22/00

[52] U.S. Cl. ..... 72/347; 72/169

[58] Field of Search ..... 72/169, 347–350, 72/370

[56] References Cited

U.S. PATENT DOCUMENTS

| | | | |
|---|---|---|---|
| 435,939 | 9/1890 | Mathewson | 72/347 |
| 1,962,510 | 6/1934 | Kellogg | 72/349 X |
| 2,418,393 | 4/1947 | Bridgens | 72/63 |
| 2,560,822 | 7/1951 | Robinson | 72/347 |

*Primary Examiner*—Leon Gilden

*Attorney, Agent, or Firm*—McGlew and Tuttle

[57] ABSTRACT

A method and apparatus of forming curved hollow elements by drawing comprising providing a die having an inlet opening, providing a punch which is mounted for rotation at a center of rotation which is in the plane of the inlet opening with the punch having a shape of a section of an annulus with a center of the annulus corresponding to the center of rotation of the punch, placing a blank over the inlet opening of the die and driving the punch into the inlet opening to shape the blank into a curved hollow element. The blank is held over the die inlet opening by a blank holder and hydraulic or pneumatic jacks are connected to the die and/or punch for moving them with respect to each other to form the curved hollow elements.

9 Claims, 10 Drawing Figures

13
VII
VII
14
15
17
1
16
12
10
18
19
5
20
2
3
11

PROCESS FOR FORMING CURVED HOLLOW ELEMENTS AND AN APPARATUS FOR CARRYING OUT THIS PROCESS

The present invention relates to a process for forming curved hollow elements, and to the products obtained by this process. The invention also relates to an apparatus for carrying out the process.

A very substantial demand for curved hollow components already exists in the areas of pneumatics and hydraulics. These components, currently referred to as elbows, are characterised by a high areal ratio on the one hand, that is to say the ratio between the diameter of the curved tube and its thickness which usually exceeds 30, and, on the other hand, in view of the small bulk desired, by a small radius of curvature of the elbow; a small radius of curvature is usually intended to denote a radius of curvature which is smaller than five times the diameter of the curved tube.

One current industrial process for production of these hollow elements consists in stamping two half-shells of sheet metal (or plate metal), and then curving the half shells which are then welded to each other to form a curved tube. Usually the curved tube thus formed is galvanised.

This known process has the disadvantage of requiring numerous operations, particularly in view of the fact that the galvanising of the welded areas cannot be performed until after the assembly of the half-shells. If the galvanising of the whole of the elbow is performed at this stage, large-capacity baths are required in view of the substantial volume of the elbows to be treated.

The present invention aims to provide a process for pressing curved hollow elements which, on the one hand, renders it possible to overcome or at least reduce the aforesaid disadvantages which, on the other hand, is very appropriate for the pressing of curved hollow elements having a high areal ratio and small radius of curvature as compared to the diameter of the hollow element.

The invention provides a process for forming curved hollow elements, in which a blank placed over the inlet opening of a die is shaped by means of a punch in the form of a section of an annulus driven in a reciprocatory motion around the center of the annulus.

The punch preferably has the form of a section having a volume generated by a geometrical figure revolving around an axis situated within its plane and not passing through its center and is driven in reciprocating motion around the centre of the annulus of which the section forms a part. For the production of elbows of circular cross-section, the punch is of toroidal form. Other elbow cross-sections may be desirable however; in these cases, the punch has a cross-section of corresponding form, for example rectangular.

It may be desirable to press elbows having a decreasing cross-section; in this case, the punch has a cross-section which reduces in a direction towards the front extremity of the punch.

A substantial advantage of the process of the invention is that it is possible to make use of blanks having a substantially circular shape, provided that they are positioned in an eccentric manner over the inlet opening of the die, the center of the blank being situated on an extension of a line between the center of the inlet opening of the die and the center of rotation of the punch.

Advantageously the punch is guided for movement around the center of rotation on the one hand, and is driven by a force applied at a distance from said point of rotation. The advantage of this separation between the guiding system and driving system of the punch consists in that despite the commonly small distance between the center of rotation of the punch and the punch itself, the force required for the driving of the punch is comparatively small compared to that which would be required if the punch had to be driven from its center of rotation.

Embodiments of the invention will now be described, by way of example, with reference to the accompanying, partly diagrammatic drawings in which.

Figure 1:
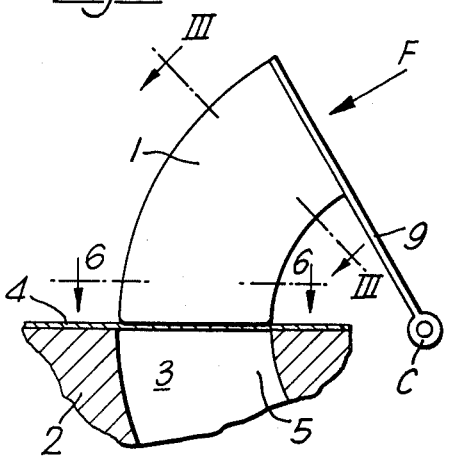
FIG. 1 is a diagram illustrating the process in accordance with the invention.

Referring to FIG. 1 which diagrammatically illustrates the process in accordance with the invention, the apparatus for forming curved hollow elements comprises a punch 1 formed by a section of a torus. The punch is driven to perform a displacement, oscillating around center C of the torus, during which displacement the punch enters a die 2 comprising a passage 3 of generally toroidal shape. A sheet metal blank 4 is placed over inlet opening 5 of the die, prior to the punch movement, and is held there by a blank holder (not illustrated) which exerts an appropriate gripping force on the blank in the direction of arrows 6.

The center of rotation C of the punch 1 is preferably situated in a plane which substantially coincides with the plane of the inlet opening 5 in the die 2.

Figure 2:
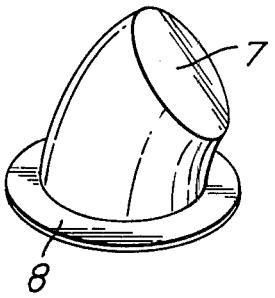
FIG. 2 shows a curved hollow element in the condition in which it issues from a shaping press, in the process in accordance with the invention.
Figure 3:
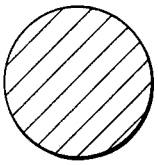
FIG. 3 is a section on the line III—III of FIG. 1, showing a punch.

During its displacement, the punch 1 shapes the blank 4 to the form of a blind toroidal tube such as that illustrated in FIG. 2, having an angular development which depends on the amplitude of the rotation of the punch.

To make the tube ready for use, it is sufficient to open its end 7, and this opening step may be performed at the end of the shaping process, as is known in the production of straight tubes; also, flange 8 is swaged over or spun over for the purpose of forming an annular bearing surface which allows an optical directional set of the tube.

The above forming operation may be performed on blanks galvanised beforehand.

The process in accordance with the invention is particularly appropriate for forming components having, on the one hand, a high areal ratio, that is to say a ratio between the diameter of the tube formed and its wall thickness which is greater than 30 and, on the other hand, a small radius of curvature, usually less than 5 times the diameter of the tube. In the case of elbows utilised in pneumatic applications, these are usually tubes having a wall thickness of the order of 0.5 to 1.5 mm and a diameter of 50 to 1600 mms, preferably of 60 to 160 mms; the radii of curvature are usually about 1, 1½ and 2 times the diameter of the bent tube.

The angular size of the bent tube which is obtainable depends on the quality of the sheet metal used and on the lubricant applied to the blank, as well as on the mechanical devices applied. Pressings of 30° and of 45°, having a diameter of the order of 10 mm and a wall thickness of the order of 1 mm, have been produced, and provision is made for reaching an angular size of 90°.

The pressing operation in accordance with the invention lends itself to blanks of generally circular shape, provided that these are positioned eccentrically over the inlet opening 5 of the die 2; the center of the blank should be located on a line passing through the center of the aforesaid opening 5 and the center of rotation C of the punch 1, and spaced beyond the center of the opening 5, that is to the left as shown in the drawing. This feature renders it possible to simplify the operations preparatory to the pressing action.

In accordance with the invention and as illustrated diagrammatically in FIG. 1, the punch is driven by a force F applied by any appropriate system of forces which is preferably separate from its center of rotation C. The latter consequently forms a guide or a joint to which the punch is connected in any suitable manner, that illustrated being an arm 9.

Figure 4:
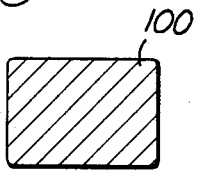
FIG. 4 is a section analogous to FIG. 3 but depicting a modified form of the punch.

Instead of having a circular cross-section, the punch may have an alternative cross-section of a shape appropriate to that of the cross-section of the bent tube required. By way of example, FIG. 4 illustrates a punch 100 having a generally rectangular cross-section.

Figure 5:
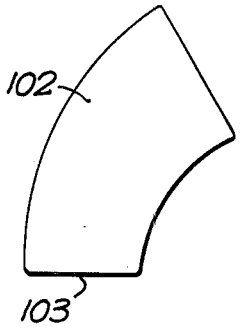
FIG. 5 is an elevation showing another form of punch.

If the curved tube produced is to have a contour of varying cross-section, the punch should have a corresponding shape. FIG. 5 illustrates a punch 102 having a cross-section decreasing evenly in the direction of front extremity 103 of the punch.

An example of a forming press appropriate for carrying out the process in accordance with the invention described with reference to FIG. 1, is illustrated diagrammatically in FIGS. 6 and 7.

Figure 6:
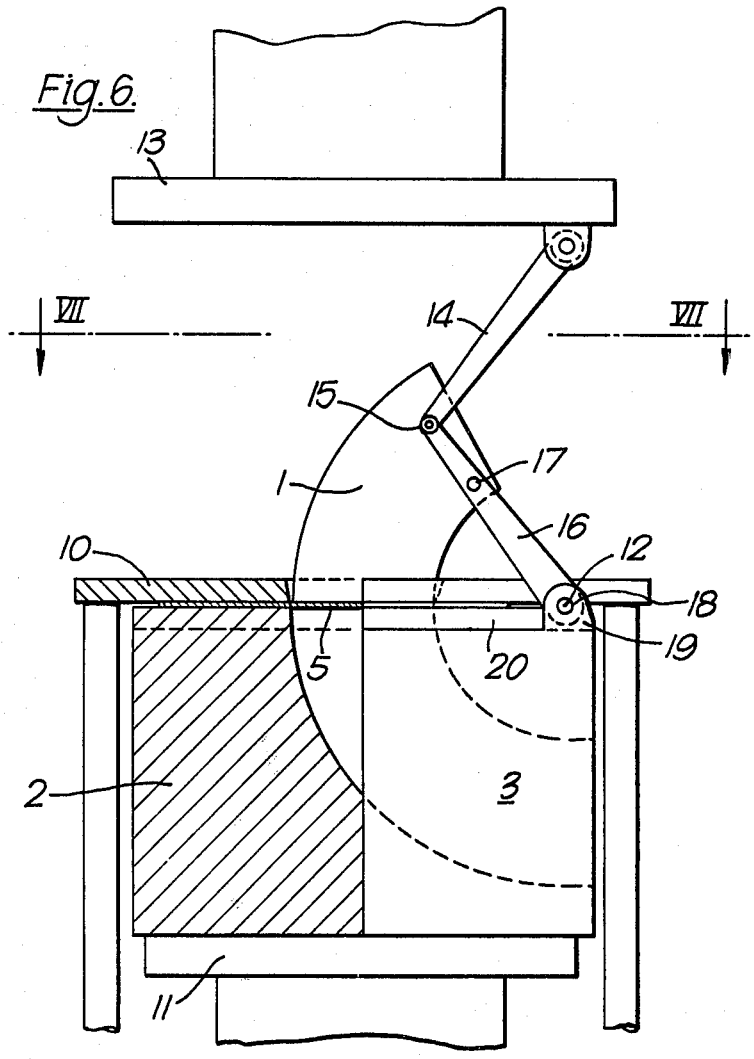
FIG. 6 is a view, partly sectional on the line VI—VI of FIG. 7, showing an example of a stamping press appropriate for application of the process illustrated in FIG. 1.
Figure 7:
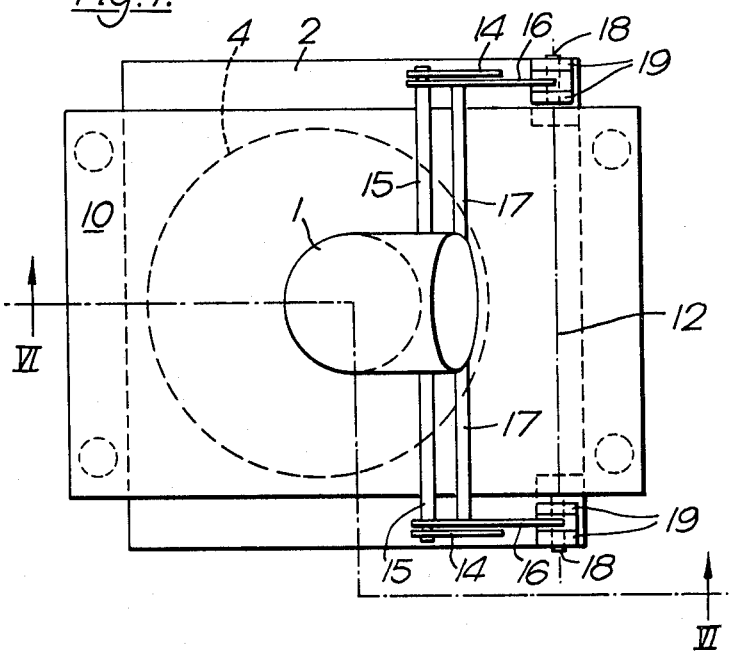
FIG. 7 is a plan partly cross-sectional view taken on the line VII—VII of FIG. 6.

In FIGS. 6 and 7, the blank holder is fixedly mounted on table 10, whereas the die 2 is connected with bottom piston 11 which acts in upward direction and is consequently thrust against the blank holder after the blank has been placed on the die. The circular blank 4, illustrated by a broken line in FIG. 7, is positioned eccentrically over the inlet opening 5 of the die 2.

The punch 1 is driven in an oscillating displacement around the horizontal axis 12 which intersects perpendicularly the plane of symmetry of the punch, the axis 12 being situated in the plane of the inlet opening 5 leading into the passage 3 of the die 2. The oscillatory displacement is effected by the translatory displacement in the vertical direction of the upper piston 13 of the press. For this purpose, the piston 13 is equipped with a pair of connecting rods 14, each being joined to a link 15 secured to the upper part of the punch 1. The guiding of the punch 1 is effected by means of a pair of levers 16 each of which is pivoted on one of the said arms 15, on an auxiliary arm 17 secured to the punch, and finally on a pivot 18 mounted in alignment with the axis 12 in a pair of lugs 19 projecting above the upper surface of a recess 20 in the die at the location of the levers 16.

Figure 8:
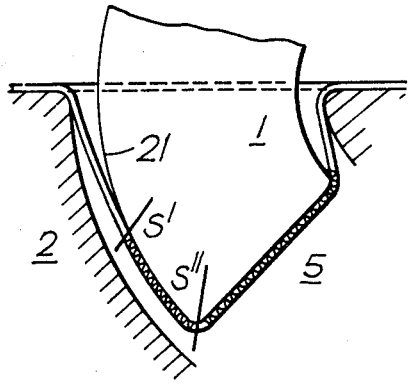
FIG. 8 is a diagram illustrating the frictional actions between the punch and the blank during the stamping operation; and, FIGS. 9 and 10 are views showing two forms of shaping press appropriate for use in the process according to the invention.

FIG. 8 illustrates the forming process, which has proved adaptable for the shaping of blanks having diameters of the order of 180 to 204 mms and wall thicknesses of the order of 0.83 to 0.96 mm, to produce curved tubes of a diameter of approximately 10 mms having an angular size between 30° and 45°. In order to be able to determint the elongations undergone by the blank as well as the nature of the flowage of the blank within the die, use has been made of the method of marking the blanks with a fine lattice within which are traced small circumferences, the deformation of which when viewed on the bent tubes renders it possible to determine the rate of elongation and constrictions of the sheet metal. It was established that the blank sticks to the outer curvature 21 of the punch 1. The areas of frictional force have been illustrated by the shaded areas. The indirect frictional forces reduce the tension on the sheet metal along the arc S″S′. It is thus the section S′ which becomes the most highly stressed; it has been established that the greater the depth of the pressing, the greater was the magnitude of the length S″S′ at the instant of fracture, which occurred at S′. It appears that this frictional action renders it possible to produce elbows having an angular development of the order of 45°, given that the area exposed to friction increases constantly during the forming action, which allows a more satisfactory distribution of the elongation.

The diagram of FIG. 8 additionally demonstrates that the die does not require a passage 5 contoured in precise manner, given that only the inlet area leading into the die acts effectively as a support for the blank. It could consequently be limited to a platform comprising an opening having a correctly contoured rim.

Figure 9:
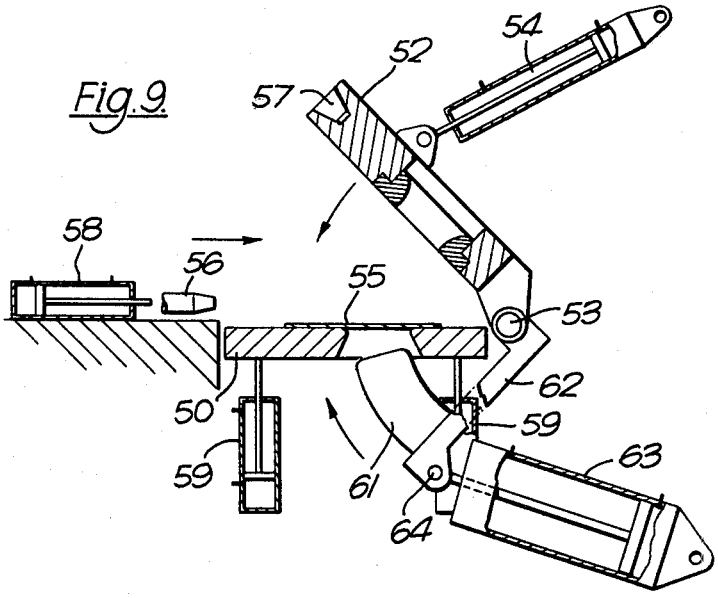

The press illustrated in FIG. 9 comprises a blank retainer 50 and a die 52 pivoting on a horizontal axis 53 under the action of an actuating jack 54. The blank 55 is placed on the blank retainer 50 in eccentric manner as in the case of FIG. 6.

When the die 52 is lowered, it can be locked in place by means of a locking device 56 received within a recess 57 of the die and actuated by a jack 58.

Four jacks 59 (two only are illustrated) exert a thrust force on the blank retainer after the locking of the die.

The punch 61 is mounted on an arm 62 (illustrated with a part cut away to show the right-hand side jack 59) which pivots on the axis 53. Consequently, there is thus a common point of rotation for the punch 61 and the die 52.

The displacement of the punch 61 is performed by means of a jack piston 63 which is appropriately dimensioned and journalled at 64.

Although a device of this nature renders a rigid and accurate structure necessary to take up the stresses exerted on the axis 53, the lock 56 and the journalling point of the jack 54, it offers two substantial advantages. On the one hand, it facilitates the withdrawal of the finished parts from the machine by simple re-raising of the die and, on the other hand there is obtained a constant thrust exerted on the die regardless of the variations of the force exerted by means of the punch during the forming operation, the force exerted on the die being solely that resulting from the jacks acting on the blank retainer.

Furthermore, this arrangement facilitates the installation of the press in a production line by providing for a lateral supply and removal of workpieces.

Figure 10:
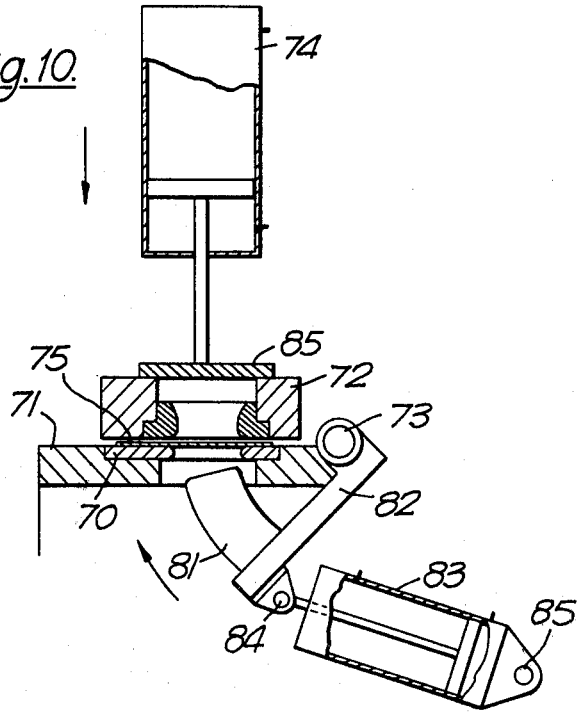

In the embodiment of FIG. 10, a blank 75 situated between a die 72 and a blank retainer 70 housed in a table 71 is shaped by means of a punch 81 mounted on an arm 82 and pivoting on an axis 73.

The punch 81 is driven by a jack 83 journalled at 84 on the arm 82 of the punch.

The die is supported by a jack or ram 74 exerting its force on a bearer plate 85.

This device does not require a locking action, but obviously the force exerted on the die is affected by the variable force applied to the punch during the forming operation.

While specific embodiments of the invention have been shown and described in detail to illustrate the application of the principles of the invention, it will be understood that the invention may be embodied otherwise without departing from such principles.

What we claim is:

1. A method of forming curved hollow elements by drawing comprising the steps of, providing a die having an inlet opening, providing a punch which is mounted for rotation about a center of rotation which is in the plane of the inlet opening, the punch having the shape of a section of an annulus with a center of the annulus corresponding to the center of rotation of the punch, placing a blank having a substantially circular shape eccentrically over the die inlet opening with the center of the blank lying on an extension of a line between a center of the die inlet opening and the center of rotation of the punch, providing a blank holder, holding the blank against the die with the blank holder, and driving the punch in a reciprocatory motion about the center of rotation thereof and into the die inlet opening to shape the blank into a curved hollow element in one step.

2. A method according to claim 1, in which the punch has the form of a section having a volume generated by a geometrical figure revolving around an axis situated within its plane and not passing through its center, the punch driven in reciprocating motion around the center of the annulus of which the section forms a part.

3. A method according to claim 1, in which the cross-section of the punch reduces in size in a direction towards the front extremity of the punch.

4. A process according to claim 3, in which the hollow elements are shaped as sections of an annulus, wherein the ratio $R/d \leqq 5$, R being the mean radius of curvature of the section of the annulus, and d being its diameter.

5. A process according to claim 4, in which the ratio R/d corresponds to one of the following values: 1, $1\frac{1}{2}$, 2.

6. A process according to claim 1, in which the hollow elements are shaped as sections of an annulus of which the ratio d/e, is equal to at least 30, d being the diameter of the section of an annulus and e its wall thickness.

7. A method according to claim 1 in which the punch is guided for movement around the center of rotation, and is driven by a force applied at a distance from the center of rotation.

8. An apparatus for forming curved hollow elements comprising, a die having an inlet opening, a blank retainer operatively connected to said die to retain a blank over said inlet opening thereof, a punch in the form of a section of an annulus mounted on an axis of rotation at the center of the annulus for to and fro movement to penetrate the inlet opening of said die which is mounted on the same axis of rotation as that of the punch, said axis being also located in a plane which substantially coincides with the plane of the inlet opening of the die, means for blocking said die in a predetermined position connected to said die, jack means connected to said blank retainer for exerting a thrust force thereon to retain a blank against said die and drive means connected to said punch for driving said punch with force into said die inlet opening to shape a blank into a curved hollow element.

9. An apparatus according to claim 8, wherein said drive means for driving said punch applies a force to said punch at a location adjacent said punch and spaced from said axis of rotation thereof.

* * * * *